United States Patent [19]

Little et al.

[11] Patent Number: 4,953,765

[45] Date of Patent: Sep. 4, 1990

[54] HORSE GROOMING ORGANIZER

[75] Inventors: Vicki A. Little, P.O. Box 781, 204 Sun Season; Barbara J. Barton, P.O. Box 782, 213 Whispering Sands, both of Santa Teresa, N. Mex. 88008

[73] Assignees: Vicki A. Little; Barbara J. Barton, ; a part interest to each

[21] Appl. No.: 294,008

[22] Filed: Jan. 6, 1989

[51] Int. Cl.[5] ..... A45F 4/00; B65D 30/22

[52] U.S. Cl. ..... 224/151; 224/224; 224/270; 224/901; 224/904; 206/373; 383/4; 383/39; 383/902

[58] Field of Search ..... 224/0.5, 101, 151, 191, 224/223, 224, 240, 226–228, 252, 253, 269–272, 901, 904, 920; 190/1, 13 R, 14, 108–110; 150/106, 112, 113; 119/83–85; 383/4, 902, 37–40; D30/158, 199; D3/30.1, 36, 38, 100, 104–106, 99; 206/373, 372

[56] References Cited

U.S. PATENT DOCUMENTS

| | | | |
|---|---|---|---|
| 259,410 | 6/1882 | Marmaduke | 383/39 |
| 2,592,087 | 4/1952 | Wallace | 224/226 |
| 2,717,391 | 9/1955 | Bracken | 224/920 |
| 3,139,133 | 6/1964 | Spector | 383/40 |
| 4,350,194 | 9/1982 | Brown | 190/110 |
| 4,682,691 | 7/1987 | Spiering | 206/373 |
| 4,690,316 | 9/1987 | Peterson | 224/253 |
| 4,747,527 | 5/1988 | Trumpower, II | 224/224 |
| 4,773,535 | 9/1987 | Cook | 383/39 |

*Primary Examiner*—Henry J. Recla
*Assistant Examiner*—Casey Jacyna
*Attorney, Agent, or Firm*—Hill, Van Santen, Steadman & Simpson

[57] ABSTRACT

A horse grooming organizer includes a generally rectangular panel member having detachably secured thereto for selective removal therefrom a plurality of variably sized storage members such as pockets or pouches adapted to be detachably secured to an apron having cooperating attachment components. The panel organizer has eye hooks and a rigid stiffening bar and is secured to a vertical surface such as a wall or gate.

7 Claims, 3 Drawing Sheets

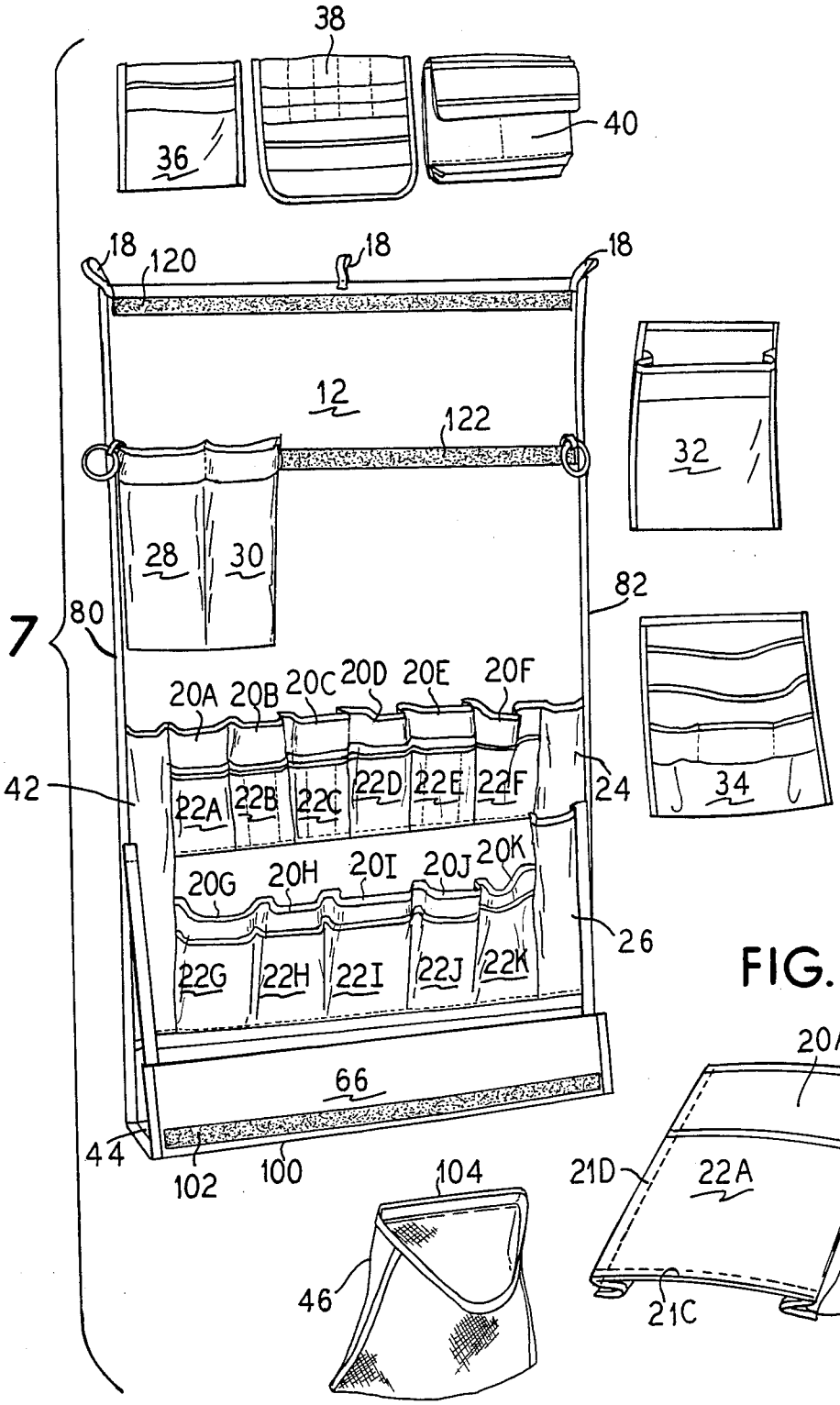
FIG. 7
FIG. 8
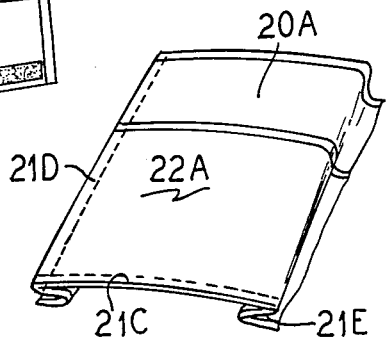

HORSE GROOMING ORGANIZER

BACKGROUND OF THE INVENTION

1. Field of the Invention

The present invention relates generally to organizers for organized storage of items especially suited to the grooming of horses. More specifically, the invention relates to an organizer having components which can be worn by a user and which utilizes selectively removable or detachable storage members for customizing its utilitarian aspects 2. Discussion of the Related Art Organizers for organized storage of items are produced in a variety of forms. Perhaps the most typical organizer includes a set or chest of drawers outside surfaces of which include labels or the like identifying the types of items to be stored therein. Additionally, there are shelving systems wherein shelf areas are labeled for the storage of specific items. Tool caddies and the like present yet another system.

In the care and grooming of horses, a variety of items or tools are utilized by personnel attending to the horses while attending to or caring for the horses Such items include various brushes of different types, leg wraps, medicine sponges, etc. To be utilized, such items must be located at or near a place of utilization and then retrieved from such storage place. Following its use, an item, if not disposed, must be stored where it can again be found.

It would be advantageous to have all of the items utilized in the care and grooming of a horse located within the vicinity of the area where the horse is to be groomed or otherwise cared for. By having all or some of the items located in a portable garment worn by the groom, the items can be more readily located. Less time and energy is expended in readily locating an item than when it cannot be located. Further, there is a reduction in frustration felt by the groom searching for the item when it can be readily located and retrieved.

It would also be advantageous to have the items to be utilized stored in designated locations. By having the items stored in an organized manner, a particular item can be more readily located. Additionally, the organized storage of tools or items is not only more pragmatically useful, but is more aesthetically pleasing than allowing them to be haphazardly stored.

Of course, these concerns are also applicable to a variety of applications and the present invention is not restricted solely to items utilized in the care and grooming of horses, although that is a particularly exemplary form of the invention. That is to say, in any task or endeavor, it is helpful to have any item or set of items used in conjunction with the task, located nearby in a stored manner so that the items can be readily located and then utilized and the present invention is designed to speak to those needs.

SUMMARY OF THE INVENTION

The present invention provides an organizer arrangement for organized storage of items, including a wall organizer; a wall organizer being an organizer that normally is supported from a wall, but which is otherwise capable of being supported from a variety of locations. The wall organizer includes storage members such as pockets and pouches attached along a panel member for storage of items therein. The organizer is adapted to be located in the vicinity of the area wherein the items are to be utilized. Certain of the storage members are detachably attached to the panel member.

Moreover, the invention provides an apron that can be worn by a groom and selectively used in cooperation with the wall organizer so that the detachable storage members can be transferred between the apron and wall organizers. Accordingly, the storage members can be removed from the wall organizer and placed on the apron organizer, and vice versa, so that any items located therein can be readily located and carried by a user thereof.

In an illustrative embodiment, the organizer arrangement is adapted for use in the care and grooming of horses. To this end, the organizer includes a variety of storage members including pouches and pockets adapted to retain therein specific items utilized in the care and grooming of horses. Each storage member is appropriately labeled with indicia identifying the particular type of item to be stored therein. A specified number of the storage numbers are detachably attached to the organizer. The organizer, in turn, is adapted to be hung from a wall or gate located in the vicinity of the area in which a horse is to be cared for.

In a preferred embodiment, the organizer arrangement includes an apron that also includes means for detachably attaching thereto the storage members that are detachably attached to the organizer located on the wall or gate. Thus, storage members can be removed from the organizer located on the wall or gate and carried on the person of someone attending to the care of a horse.

Accordingly, it is an advantage of the present invention to provide an organizer arrangement for organized storage of items.

It is another advantage of the invention to provide an organizer arrangement for organized storage of items, wherein the wall organizer is adapted to be hung from a vertical surface.

It is yet another advantage of the invention to provide an organizer arrangement wherein certain of the storage members are detachably attached to a panel member.

It is a further advantage of the invention to provide an apron member adapted to receive storage members detachably attached thereto so that items stored in the storage members can be carried on the person of someone wearing the apron member.

It is a principal advantage of the invention to provide an improved organizer arrangement for organized storage of items utilized in the care and grooming of horses.

Additional features and advantages are described in, and will be apparent from, the detailed description of the presently preferred embodiment and from the drawings.

BRIEF DESCRIPTION OF THE DRAWINGS

In the drawings:

FIG. 7 is an exploded perspective view of the wall organizer of FIG. 1 illustrating which storage members are detachable storage members.

DETAILED DESCRIPTION OF THE PRESENTLY PREFERRED EMBODIMENTS

Figure 1:
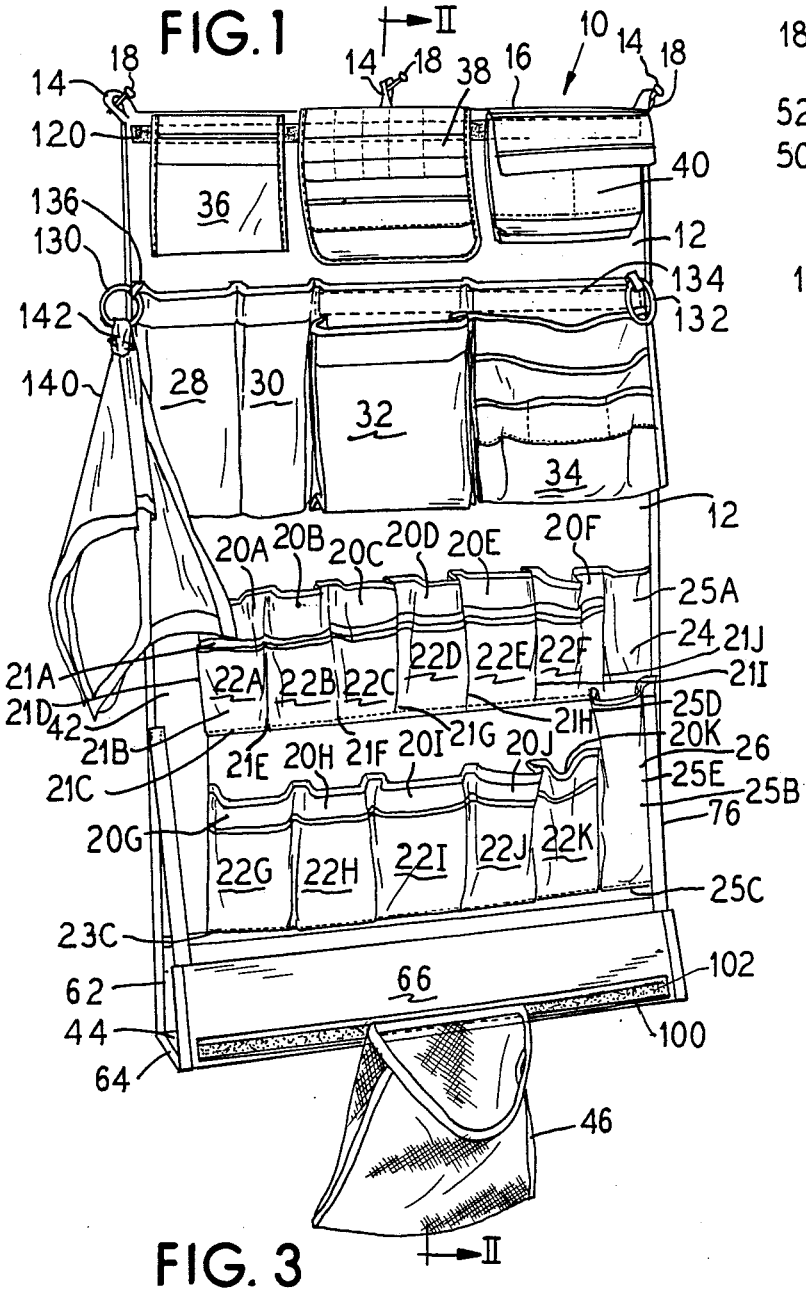
FIG. 1 is a perspective view of a wall organizer embodying principles of the invention.
Figure 2:
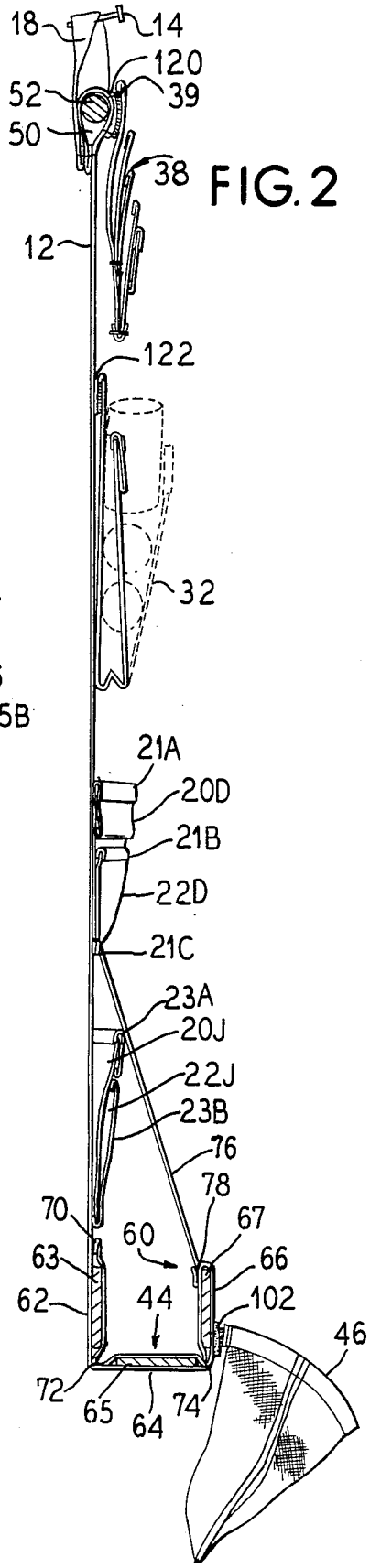
FIG. 2 is a cross-sectional view of the wall organizer of FIG. 1 taken generally along the lines II—II in FIG. 1.

In FIGS. 1, 2, and 7 there is illustrated a wall organizer 10 that embodies principles of the invention. The wall organizer 10 includes a rectangular panel member 12 that can be hung on a vertical surface such as a wall by means of eyelets 14 that are attached along a top edge 16 of the panel member 12. Of course, the panel member 12 can be hung from any suitable support and its placement is not restricted to walls. A vertical wall is preferred because of the support it gives to the panel member 12. Most notably, the panel member 12 can also be hung on a wall or gate located in the vicinity of an area where a horse is to be cared for or groomed, such as tack room. Thus, the term "wall" is not intended to limit the application of the organizer 10.

The panel member 12 preferably is made out of a fabric that is sturdy and flexible. An example of such fabric is heavy poplin. The aim is to use a fabric that is not too heavy and yet can withstand repeated use as items such as horse care brushes and the like are stored and retrieved from the storage members attached to the panel member 12.

As also illustrated in FIGS. 1, 2, and 7 there are a plurality of storage members attached to the panel member 12 on one side of the panel member 12. These storage members include: pocket members 20A-20K, 22A-22K, 24, 26, 28, 30, 32, 34, and 42; pouch members 36, 38, and 40; shelf member 44; and netting member 46. A pouch member merely is a specially adapted pocket member that includes a closure member such as a flap for closing the pocket member. It can be appreciated that the storage members, with the exception of netting member 46, preferably are made out of the same material as the panel member 12. However, this is for aesthetic reasons and is not necessary for the integrity of the organizer 10 or for practicing the invention.

Along its top edge 16, the panel member 12 is doubled over to form a channel 50 within which there is inserted stiffening means such as a rod or a pole 52. The pole 52 is utilized to provide a stiffening member at the top edge 16 of the panel member 12 to maintain the panel member 12 in its rectangular shape as it is supported from a wall by means of the eyelets 14. Further, the pole 52 distributes the unit loading of the hanging forces of the panel member 12 evenly along the length of the pole 52.

At a bottom end 60 of the panel member 12, there is included the relatively rigid shelf member 44 formed by three laterally extending rectangular channel sections 62, 64, and 66 located adjacent to each other at the bottom end of the panel member. These three rectangular channel sections 62, 64, and 66 extend transversely in parallel side-by-side relation to one another and are formed by taking bottom end 60 of the panel member 12, folding it, and then stitching it along horizontal edges 70, 72, and 74, which operate as hinges so that the sections may be folded. Three complementary-sized rigid boards 63, 65, and 67 are inserted into the rectangular channel sections 62, 64, and 66, respectively, so as to provide flat stiffening members therein for rigidifying and support purposes. Additionally, a pair of straps 76 are attached to a top edge 78 of the outermost rectangular channel section 66 and to left and right edges 80 and 82, respectively, of the panel member 12 to prevent the outermost rectangular channel section 66 from simply flopping down and to provide a cantilever support to resist the vertical forces and thereby to form and maintain the shelf member 44 in a horizontal position. As shown in FIG. 2, the shelf is trough-shaped in cross-section.

It can be appreciated that the shelf member 44 thus formed, can be utilized for storing a variety of items including elongate objects such as poles.

The pocket members 20A-20F and 22A-22F are formed by positioning two panel members 21A and 21B on top of each other, the innermost panel member 21A having a width greater than that of the outermost panel member 21B, and then forming gusseted pockets by appropriately stitching the two panel members 21A and 21B to the panel member 12 along a common horizontal edge 21C and then along vertical edges 21D–21J so as to form the pocket members.

During the stitching along the bottom edge 21C, the panel members 21A and 21B are appropriately folded along each side of the pocket members 20A-20F and 22A-22F to be formed so that the pocket members will bulge slightly from the panel member 12. To this end, the left and right edges of each of the pocket members 20A-20F and 22A-22F are tucked inward (as illustrated in FIG. 8 in connection with pocket member 20A and 22A) to form wedged-shaped pockets. Then the panel members 21A and 21B are stitched along the bottom edge 21C. When stitched along the bottom 21C, the pocket members will have the appearance of a flat edge. However, the pocket members will have a wedge shape as the unfolded and unstitched top edges bulge outward from the panel member 12.

It can be appreciated that because the two panel members 21A and 21B are sewn together along the common bottom edge 21C, two pocket members, for example, the pocket members 20A and 22A are formed simultaneously, one in front of the other. Thus, if yet smaller pocket members are required, the outermost pocket member 22A can be appropriately stitched along vertical lines to the innermost pocket member 20A so as to subdivide the pocket member 22A into yet smaller pocket members.

The pocket members 20G-20K and 22G-22K are similarly formed. However, it can be appreciated that these pocket members are formed so as to be of slightly larger dimensions and, accordingly, they are fewer in number than the pocket members 20A-20F and 22A-22F.

In the preferred embodiment, the pocket members 20A to 20K include lettering or indicia thereon to indicate that such pocket members are adapted to receive specific designated items therein. Thus, items stored therein can be readily located by someone desiring to utilize same.

In the preferred embodiment, pocket 20A is labeled ALCOHOL; pocket member 20B is labeled LEG BRACE AND BRUSH; pocket member 20C is labeled LEG PAINT AND BRUSH; pocket member 20D is labeled GLYCERIN AND PEPPERMINT; pocket member 20E is labeled LINIMENT; pocket member 20F is labeled MISCELLANEOUS; pocket member 20G is labeled CLIPPERS; pocket member 20H is labeled BRUSH; pocket member 20H is labeled BRUSH; pocket member 20J is labeled FLY SPRAY; and pocket member 20K is labeled MISCELLANEOUS. Pocket members 22A-22K are unlabeled.

For the storage of larger items, the panel member also includes thereon the additional pocket members 24, 26, and 42. These pocket members are formed in a manner similar to those described previously. The pocket member 42 is adapted to receive therein a large item such as a dose gun. In the preferred embodiment, the pocket member 42 is appropriately labeled DOSE GUN. The pocket member 42 is appropriately formed by attaching a longitudinal panel member to the panel 12 along the left edge 80 of the panel member 12 and appropriately stitching the longitudinal panel member along a bottom edge 42A and along side edges 42B and 42C.

The pocket members 24 and 26 are formed together and are adapted to receive therein, items such as a twitch and a sweat scraper, respectively. In the preferred embodiment, the pocket members 24 and 26 are appropriately labeled TWITCH and SWEAT SCRAPER, respectively. The pocket members 24 and 26 are formed by attaching a longer inside longitudinal panel member 25A and a shorter outside longitudinal panel member 25B to the panel member 12 along the right edge 82 thereof. The panel members 25 and 25B are attached to the panel member 12 along a common bottom edge 25C and common side edges 25D and 25E. Thus, the panel member 25B forms the pocket member 26 between the inner longer panel member 25A and the outer shorter panel member 25B, while the panel member 25A forms the pocket member 24 between the panel member 12 and the inner longer panel member 25A.

Along a bottom edge 100 of the outside surface of the rectangular channel section 66 of the shelf 44, there is included a strip of material 102 composed of a plurality of hook members. Such a strip can include a thin strip of a fibrous mat surface. Such a strip of material can be utilized as the loop component of a hook and loop fastener so that items such as the pocket made out of the netting member 46 can be detachably attached thereto, the netting member 46 including an appropriate patch at 104 of a plurality of loop components secured thereto.

As it is illustrated most clearly in FIG. 7, the panel member 12 further includes two laterally extending strips 120 and 122 of material including a plurality of loop members so as to provide the loop component of a hook and loop fastener. These strips of material 120 and 122 can also include a strip of fibrous mat. These strips of material are utilized to permit storage members 32, 34, 36, 38, and 40 to be detachably attached to the panel member 12.

Figure 3:
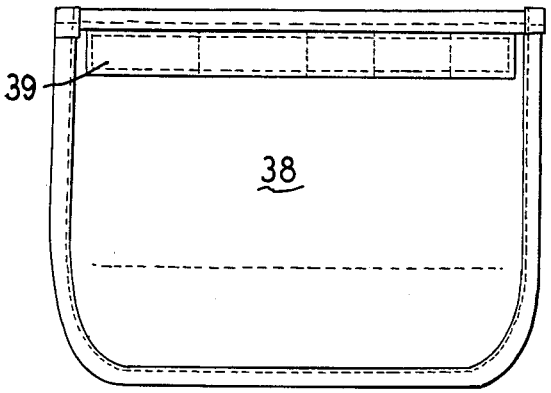
FIG. 3 is a backside view of a detachable storage member utilized in conjunction with the wall organizer of FIG. 1 in accordance with principles of the invention.

To this end, each of the storage members 32, 34, 36, 38, and 40 includes a back surface on which there is attached the hook component of a hook and loop fastener so that each of the storage members 32, 34, 36, 38, and 40 can be attached to the panel member 12 along either of the strips of material 120 and 122. This is seen most clearly in FIG. 3, wherein the back of the storage member 38 is illustrated a strip of material 39 that is a strip of hooks forming the hook component of a hook and loop fastener.

It can be appreciated that the storage members 32, 34, 36, 38, and 40 can be removed from the panel member 12 and be replaced thereon in different positions. However, as illustrated in FIGS. 1 and 7, the storage members 32 and 34 are of a slightly larger size than the storage members 36, 38, and 40 and thus, are more adapted to be detachably attached to the panel member 12 on the strip member 122 as more clearance is provided thereon for the larger storage members.

It can be appreciated that the storage members 32, 34, 36, 38, and 40, as well as the netting member 46, can be attached to the panel member 12 by means of other attachment means. For example, the storage members can be detachably attached to the panel member 12 by means of snaps, hooks, buttons, or zippers, to name a few. Further, it can be appreciated that the attachment of the various components of the hook and loop fasteners can be reversed, i.e., the strips of material 102, 120, and 122 can comprise the hook component of a hook and loop fastener while the strips of material located on the back of each of the storage members can comprise the loop component of the hook and loop fastener. However, for aesthetic and other reasons, such as to avoid exposure to a highly abrasive surface, it is preferred to utilize the component of the hook and loop fastener as the strips of material 102, 120, and 122.

Figure 4:
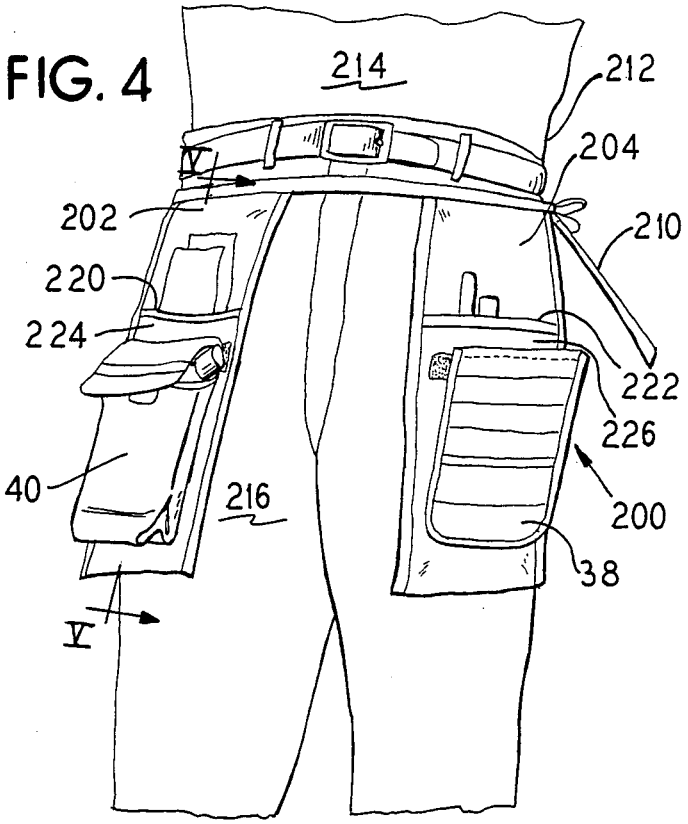
FIG. 4 is a perspective view of a person wearing an apron organizer embodying principles of the invention and utilized in conjunction with the detachable storage members of the organizer of FIG. 1 in accordance with principles of the invention.
Figure 5:
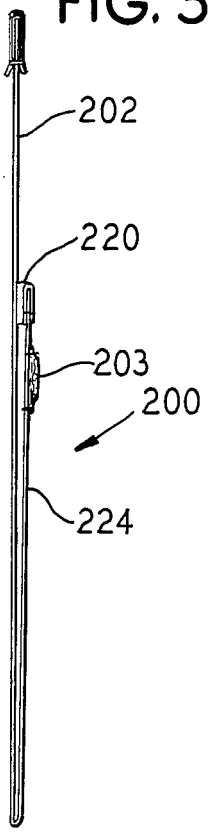
FIG. 5 is a cross-sectional view of the apron organizer of FIG. 4 taken generally along the lines V—V.
Figure 6:
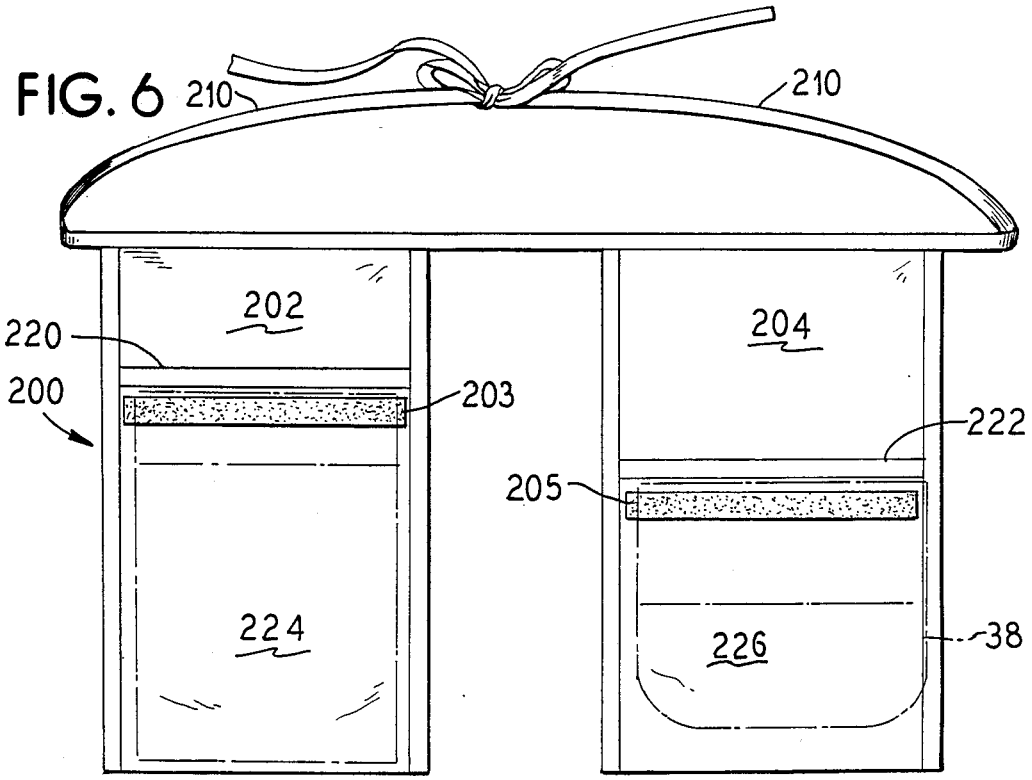
FIG. 6 is a front view of the apron organizer of FIG. 4.

As illustrated in FIGS. 4, 5, and 6, the organizer includes an apron component 200 that can be selectively worn by a groom utilizing the invention to temporarily carry parts of the wall organizer 10. The apron component 200 includes two panel members 202 and 204 that are adapted to receive thereon at least two of the detachable storage members 32, 34, 36, 38, and 40 while leaving clearance for the knees of the user in bending or kneeling. To this end, there is included on each of the panel members 202 and 204, a strip of material 203 and 205, respectively. Again, the strip of material is formed of the loop component of a hook and loop fastener such as a strip of fibrous matting. Also again, the strip of material can be replaced by other attaching means such as snaps, buttons, zippers and the like for detachably attaching the storage members 32, 34, 36, 38, and 40 thereto, provided the detachable storage members include cooperating fastening means.

The apron component 200 further includes a pair of drawstrings 210 for securing the apron component 200 about the waist 212 of a person 214. It can be appreciated that when worn, the panel members 202 and 204 lay against the thighs 216 of the wearer 214 and that the panel members 202 and 204 do not extend around the body of the person 214. However, it can also be appreciated that the apron component 200 could be constructed, if it is so desired, to accept further storage members thereon. This can be accomplished by enlarging the panel members 202 and 204.

The apron component also includes a pair of pocket members 220 and 222 permanently formed thereon by means of the attachment of a second pair of panel members 224 and 226, respectively, that are attached along the bottom and vertical edges of the panel members 202 and 204. Unlike the pocket members formed on the panel member 12, however, these pocket members are not formed so as to have wedge-shaped pockets, as it is desired to keep the outside panel members as taut as possible so that the detachable storage members are held securely against the thigh of the wearer.

As is most clearly seen in FIG. 7, the storage members 28, 30, 32, 34, 36, 38, and 40 also include labels or indicia identifying items stored or to be stored therein. To this end, the storage members 28 and 30 are labeled MISCELLANEOUS for the storage of non-specific items. The storage member 32 is labeled LEG WRAPS for the storage of leg wraps for horses. The storage member 34 includes the labels BIG STUFF, TAPE, RUBBER BANDS, and PINS, on the various individual storage pockets thereon, all items employed in the care of horses. The label BIG STUFF refers to non-specific items that are too large to be adequately stored in a smaller storage member. Further, the storage member 36 is appropriately labeled RECEIPTS, while the storage members 38 and 40 are respectively labeled LITTLE STUFF and MEDICINE.

By including such designation labels, personnel attending to the care and/or grooming of a horse can readily identify items that are to be employed. Then, the storage members containing the needed items can be selectively detached from the panel member 12 and temporarily attached to the panel members 202 and 204 of the apron member 200. It can be appreciated that with hook and loop fasteners greatly facilitate such transfer of the storage members as the storage members are easily detached and reattached simply by pulling away and replacement of same.

The panel member 12 also includes two ring members 130 and 132 secured to the panel member 12 by means of eyelets 134 and 136, respectively. Such ring members preferably are made of metal and are utilized for securing tacks thereto, i.e., gear used in equipping a horse, or as illustrated in the drawings, items such as a cloth member 140, the cloth member 140 including appropriately formed means 142 for securing same to a ring member. The cloth member 140 could, of course, simply be threaded through one of the ring members 130 or 132.

It should be understood that we wish to embody within the scope of the patent warranted hereon, all such modifications as reasonably and properly come within the scope of our contribution to the art.

We claim:

1. A horse grooming organizer system comprising:

a generally rectangular sheet-form body member made of flexible fabric;

a doubled over edge at a top end of said sheet-form body member and connected at its edge in firm assembly with said body member to form a transverse channel;

stiffening means comprising a rod-like pole in said channel;

eyelet support members positioned at opposite sides of said transverse channel by means of which said body member can be suspended from a support;

a folded over edge at a bottom end of said sheet-form body member and operatively connected in firm assembly with said body member to form a plurality of transversely extending rectangular channel sections;

planar rigidifying means in said channel sections;

strap means connected to opposite sides of the bottom end of said body member at the endmost of said channel sections and to lateral edges of said body member thereby to form the channel sections into a rectangular trough-shaped shelf;

a plurality of transversely extending hook and loop fastening strips connected to said body member to form spaced apart parallel connecting means; and a plurality of pouches and pockets forming storage members releasably secured to the connecting means, each storage member having a cooperating hook and loop fastening strip attached to a backside thereof for matching with one of said connecting means, said pockets and pouches being variably shaped and configured to receive horse grooming components of complementary size and shape.

2. A horse grooming organizer system as set forth in claim 1, wherein the sheet-form body member comprises a rectangular flexible sheet of poplin fabric.

3. A horse grooming organizer system as defined in claim 1, wherein the storage members include indicia on a front face thereof for identifying and designating particular items to be stored within the storage member.

4. A horse grooming organizer system as defined in claim 1, further comprising an apron member made of a flexible fabric and having first and second panel members adapted to be worn on the thighs of a user, said panel member being operatively adapted for detachable attachment of said storage members thereto by means of cooperating strips of hook and loop fasteners attached to the apron panel members.

5. A horse grooming organizer system as defined in claim 4, wherein the sheet-form body storage members are made out of heavy poplin and the apron member is made out of a lighter fabric.

6. A horse grooming organizer system as defined in claim 1, further comprising a separate apron member having at least one panel member with cooperating hook and loop attachment means for detachably attaching thereto any of said detachable storage members.

7. A horse grooming organizer system as defined in claim 1, wherein:

said sheet-form body includes a hook and loop fastening strip transversely attached along said endmost channel section such that said fastening strip faces forwardly on a bottom edge of a front face of said trough-shaped shelf.

* * * * *